US008234754B2

(12) United States Patent
Yamaguchi et al.

(10) Patent No.: US 8,234,754 B2
(45) Date of Patent: Aug. 7, 2012

(54) HINGE MODULE AND ELECTRONIC EQUIPMENT

(75) Inventors: Shigeru Yamaguchi, Kawasaki (JP); Shingo Yamaguchi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 407 days.

(21) Appl. No.: 12/365,568

(22) Filed: Feb. 4, 2009

(65) Prior Publication Data

US 2009/0211057 A1 Aug. 27, 2009

(30) Foreign Application Priority Data

Feb. 25, 2008 (JP) ..... 2008-043336

(51) Int. Cl.
*E05D 15/06* (2006.01)

(52) U.S. Cl. ..... 16/361; 16/364; 16/362; 16/239; 16/357

(58) Field of Classification Search ..... 16/362, 16/363, 364, 378, 386, 357, 360, 361, 239; 455/575.3; 379/433.11, 433.12, 433.13; 361/679.06, 679.07, 679.11, 679.12, 679.15, 361/679.16, 679.2, 679.27, 679.28
See application file for complete search history.

(56) References Cited

U.S. PATENT DOCUMENTS

| | | | | |
|---|---|---|---|---|
| 4,001,913 | A * | 1/1977 | Ollis et al. | 16/88 |
| 6,522,529 | B1 * | 2/2003 | Huilgol et al. | 361/679.06 |
| 7,546,150 | B2 * | 6/2009 | Makino | 455/575.1 |
| 7,792,555 | B2 * | 9/2010 | Kawasaki et al. | 16/367 |
| 7,818,038 | B2 * | 10/2010 | Huang | 455/575.4 |
| 2007/0227873 | A1 | 10/2007 | Kawasaki et al. | |
| 2008/0004083 | A1 * | 1/2008 | Ohki et al. | 455/566 |
| 2008/0051162 | A1 * | 2/2008 | Kim et al. | 455/575.3 |
| 2008/0096619 | A1 * | 4/2008 | Kuga et al. | 455/575.4 |
| 2008/0242380 | A1 * | 10/2008 | Kajihara et al. | 455/575.4 |
| 2008/0301909 | A1 * | 12/2008 | Chien et al. | 16/362 |

FOREIGN PATENT DOCUMENTS

JP 2007-292280 11/2007

* cited by examiner

*Primary Examiner* — Victor Batson
*Assistant Examiner* — Jeffrey O Brien
(74) *Attorney, Agent, or Firm* — Staas & Halsey LLP

(57) ABSTRACT

A hinge module includes a first hinge part; and a second hinge part confronting the first hinge part. The first hinge part includes a slot; and an annular groove surrounding the slot and formed in a recessed shape in relation to the second hinge part, and an annular gasket inserted into the annular groove and projecting to the second hinge part side. The second hinge part includes a cylindrical projection non-removably inserted into the slot while freely moveable in a longitudinal direction of the slot; and a sliding surface formed around periphery of the cylindrical projection and on which the gasket slides.

16 Claims, 18 Drawing Sheets

HINGE MODULE AND ELECTRONIC EQUIPMENT

CROSS-REFERENCE TO RELATED APPLICATION

This application is based upon and claims the benefit of priority of the prior Japanese Patent Application No. 2008-043336, filed on Feb. 25, 2008, the entire contents of which are incorporated herein by reference.

FIELD

The present invention relates to electronic equipment having, for example, a rotating mechanism and a sliding mechanism as well as having a waterproof function and to a hinge module disposed in the electronic equipment.

BACKGROUND

Recently, there is known electronic equipment, for example, a mobile phone having a mechanism for sliding the mobile phone while rotating.

FIGS. 1 to 4 show an outside appearance of a mobile phone having a mechanism for making a sliding motion while making a rotating motion. FIG. 1 is a perspective view showing a display unit in a standing state. FIG. 2 is a perspective view showing the display unit in a leftward-fallen state. FIG. 3 is a perspective view showing the display unit in a rightward-fallen state. FIG. 4 is a perspective view showing a state that the display unit is closed on a main body unit.

A mobile phone 10 has a main body unit 20, a support unit 30 openably and closably attached to the main body unit 20 through a hinge 31, and a display unit 40 rotatably and slidably supported by the support unit 30.

The main body unit 20 has a number of keys 21 disposed thereon. The support unit 30 has a first camera 32 and a second camera 33. The display unit 40 has a main screen 41 and a sub screen 42. The mobile phone 10 can be opened and closed between an open state shown in FIG. 1 and a closed state shown in FIG. 4. The display unit 40 is rotated between a standing state shown in FIG. 1, a leftward-fallen state shown in FIG. 2, and a rightward-fallen state shown in FIG. 3 and can maintain a stable attitude in these three states.

The mobile phone 10 can transmit and receive a phone call and an electronic mail using radio communication. The mobile phone 10 has a function for receiving an image of a digital television broadcast. Since a television image can be seen easily in a state that the main screen 41 is fallen laterally, the mobile phone 10 has a structure capable of falling the display unit 40 laterally.

Incidentally, the display unit 40 of the mobile phone 10 shown in FIGS. 1 to 4 can operate only a rotating motion with respect to the support unit 30, cannot be shifted from the standing state shown in FIG. 1 to the leftward-fallen state shown in FIG. 2. In this case, when the display unit 40 intends to fall the display unit 40 leftward as shown in FIG. 2 from the standing state shown in, for example, FIG. 1, a lower edge left corner 43 of the display unit 40 interferes with a base portion 34 of the support unit 30 for supporting a lower edge of the display unit 40. To cope with this problem, the display unit 40 has a mechanism that can rotate as well as slide up and down with respect to the support unit 30. When the display unit 40 is rotated leftward to shift from the standing state as shown in FIG. 1 to the leftward-fallen state as shown in FIG. 2, the display unit 40 rotates while sliding upward until half way due to the interference of the lower edge left corner 43 of the display unit 40 with the base portion 34 of the support unit 30.

Then, the display unit 40 is rotated while sliding downward from half way by being urged by an urging member (not shown) and is placed in the leftward-fallen state shown in FIG. 2. This is also the same when the display unit 40 is shifted from the leftward-fallen state as shown in FIG. 2 to the standing state as shown in FIG. 1. Further, when the display unit 40 is rotated between the standing state as shown in FIG. 1 and the rightward-fallen state as shown in FIG. 3, the display unit 40 slides while rotating similarly except that a lower edge right corner 44 of the display unit 40 interferes with the base portion 34 of the support unit 30.

As a recent trend, a waterproof function is desired in a mobile phone, and a mobile phone having a waterproof function is also known. However, a mobile phone with a waterproof function, which slides while rotating, is not yet known.

As described above, there is not conventionally known electronic equipment, which is characterized in a mechanism for sliding the electronic equipment while rotating and in which a hinge module has a waterproof and dustproof performance. There are an oil seal of a hydraulic piston, a seal around a rotary shaft, and the like as a similar structure. However, these mechanisms move only in one linear direction in the piston or only rotate in one circumferential direction in the rotary shaft. Although there is also a mechanism for making a reciprocating motion in the direction of a rotary shaft while being rotated, a seal member in this case is compressed only in the radial direction of the shaft. Further, many of these structures have a large size and are not suitable for compact electronic equipment.

Japanese Laid-open Patent Publication No. 2007-292280 discloses a waterproof structure in mobile electronic equipment. However, Japanese Laid-open Patent Publication No. 2007-292280 discloses a structure for making only a rotational motion and does not disclose a mechanism for making a sliding motion.

SUMMARY

According to an aspect of an embodiment of the invention, a waterproof type hinge module and an electronic equipment is provided, in which a mechanism for making a rotational motion as well as making a sliding motion in a direction different from a rotating shaft is realized.

According to an aspect of the invention, a hinge module is included a first hinge part and a second hinge part confronts the first hinge part, wherein the first hinge part includes a slot, and an annular groove surrounding the slot and formed in a recessed shape relation to the second hinge part, and an annular gasket inserted into the annular groove and projecting to the second hinge part side, and the second hinge part includes a cylindrical projection non-removably inserted into the slot while freely moveable in a longitudinal direction of the slot and a sliding surface formed around the periphery of the cylindrical projection and on which the gasket slides.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DESCRIPTION OF EMBODIMENTS

Figure 1:
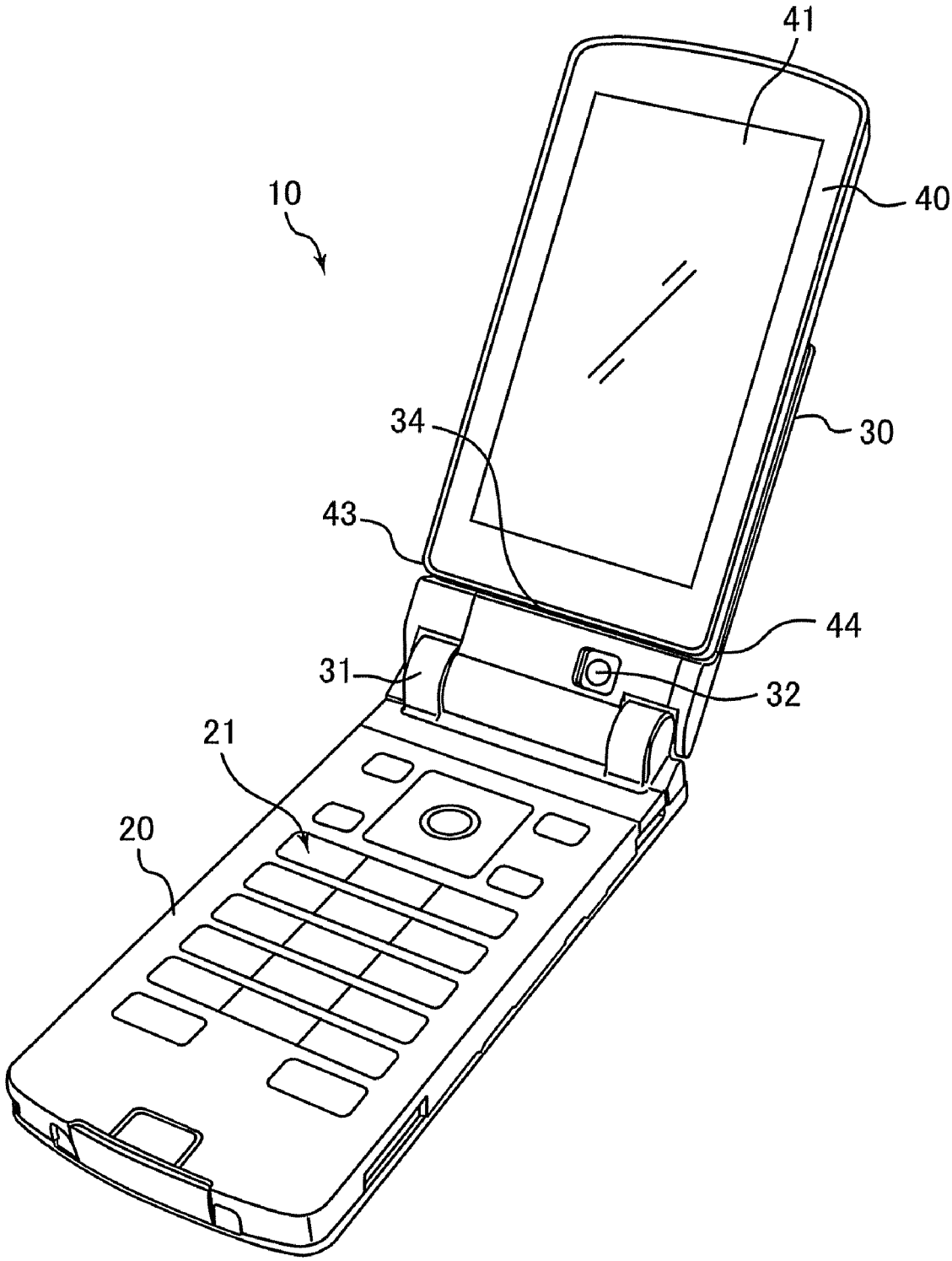
FIG. 1 is a perspective view showing a display unit in a standing state.

An embodiment of equipment will be explained referring to the drawings.

In the embodiment, a mobile phone will be explained as an example of electronic equipment. However, since the outside appearance of the mobile phone and the motions of parts thereof when viewed from an outside are the same as those shown in FIGS. 1 to 4, duplicate explanation of the outside appearance of the mobile phone and the motions of the mobile phone on the outside appearance is omitted by referring to FIGS. 1 to 4 as they are.

FIG. 5 is a view showing a hinge module interposed between the support unit and the display unit of the mobile phone shown in FIGS. 1 to 4.

A portion which relates to attachment to a hinge module 100 of the support unit 30 shown in FIGS. 1 to 4, is called a first case 300, and a portion, which relates to attachment to the hinge module 100 of a display unit 40 shown in FIGS. 1 to 4, is called a second case 400.

Figure 5B:
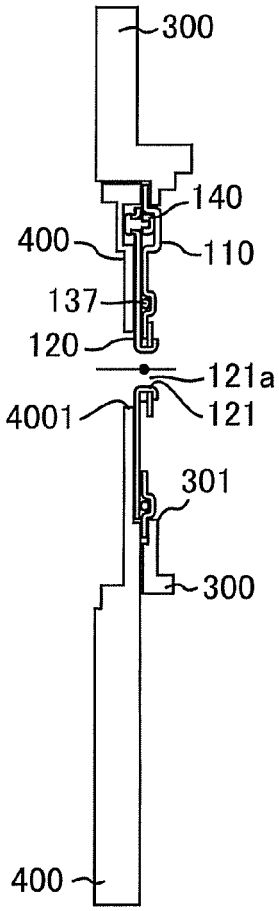
FIG. 5B is a sectional view taken along a line B-B of FIG. 5A.
Figure 5A:
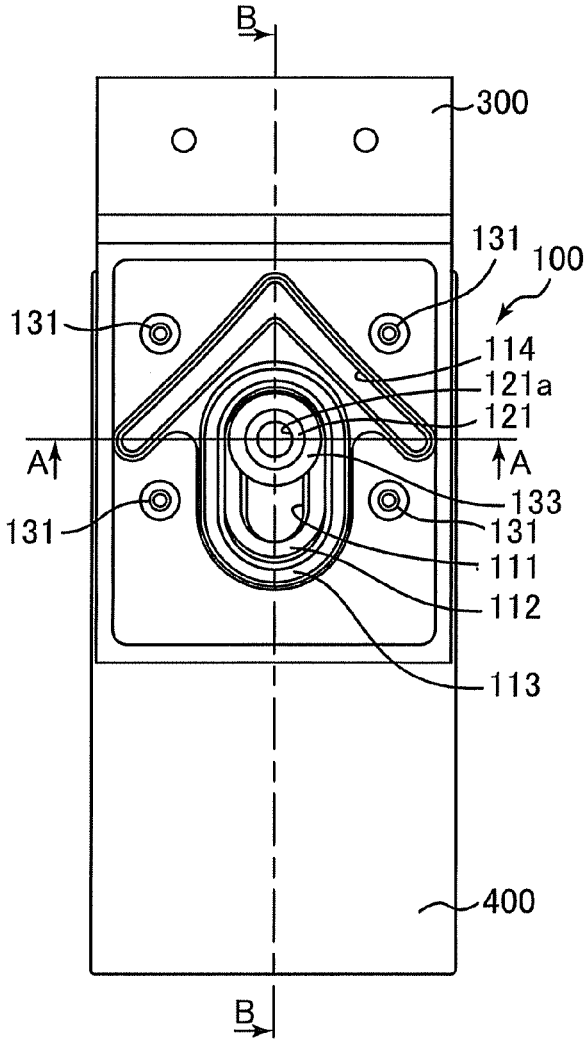
FIG. 5A is a plan view showing a hinge module interposed between a support unit and the display unit of a mobile phone when viewed from a first case side.
Figure 5C:
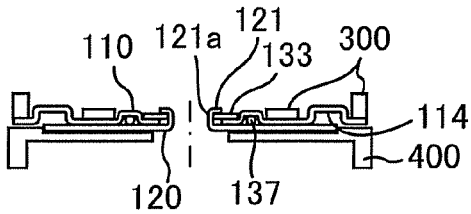
FIG. 5C is a sectional view taken along a line A-A of FIG. 5A.

FIG. 5A is a plan view showing the hinge module 100 interposed between the support unit and the display unit of the mobile phone when viewed from a first case side. FIG. 5B is a sectional view taken along a line B-B of FIG. 5A. FIG. 5C is a sectional view taken along a line A-A of FIG. 5A. However, some portions, for example, an opening 301 and the like shown in FIG. 5B are omitted in a plan view shown in FIG. 5A to simplify illustration. This is also the same in FIGS. 5B and 5C.

The hinge module 100 has a first sheet-shaped hinge part 110 which is fixed to the first case 300 constituting a part of the support unit 30 as shown in FIGS. 1 to 4. The hinge module 100 has a second sheet-shaped hinge part 120 fixed to the second case 400 constituting a part of the display unit 40 and extending in confrontation with the first hinge part 110 as shown in FIGS. 5A-5C. The first case 300 has the large opening 301 formed such that a central portion of the first hinge part 110 can be seen therethrough. The second case 400 has an opening 4001 which opens only around the periphery of a hole 121*a* of a cylindrical projection 121 of the second hinge part 120 to be described later.

Figure 6:
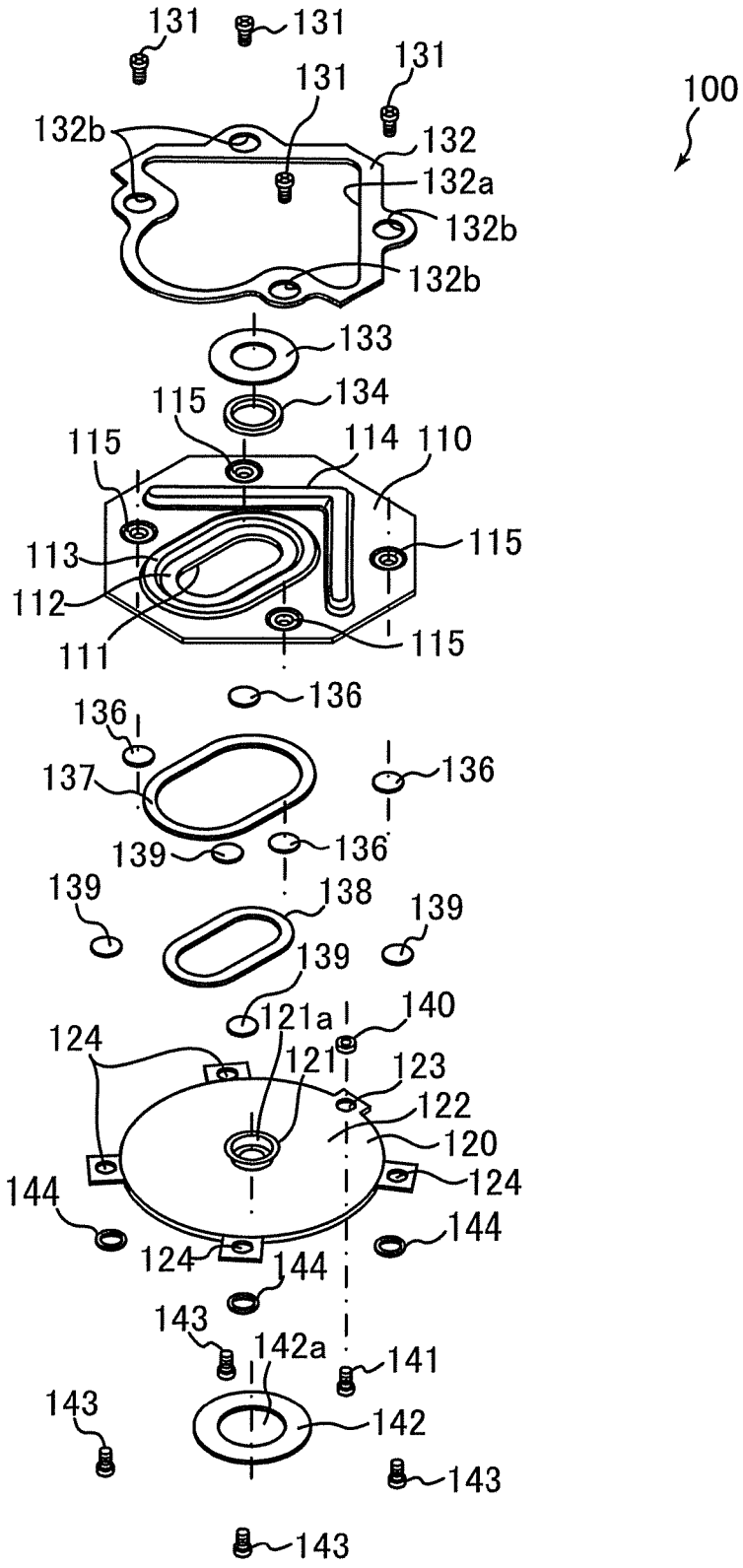
FIG. 6 is an exploded perspective of the hinge module.

FIG. 6 is the exploded perspective of the hinge module.

Although the first case 300 and the second case 400 are not shown in FIG. 6, the first case 300 is located above a waterproof double-faced tape 132 shown in an upper portion of FIG. 6, and the second case 400 is located under a waterproof double-faced tape 142 shown in a lower portion of FIG. 6.

The hinge module of the embodiment will be explained below referring to FIGS. 5A, 5B, 5C, and 6.

The first hinge part 110 has a slot 111, which passes through the front and back surfaces thereof, and an annular groove 113, which surrounds an entire edge portion 112 that surrounds the slot 111. The annular groove 113 is formed in a direction in which is recessed toward the second hinge part 120. The annular groove 113 is filled with an annular waterproof gasket 137. Since the gasket 137 has a thickness larger than the depth of the annular groove 113, a part of the gasket 137 in the thickness direction projects to the second hinge part 120 side and comes into collision with a sliding surface 122 of the second hinge part 120. Relative motion between the first hinge part 110 and the second hinge part 120 causes the gasket 137 to slide on the sliding surface 122 to prevent water from entering from a gap between the first hinge part 110 and the second hinge part 120.

The first hinge part 110 has a runway groove 114 which is formed in a recessed shape with respect to the second hinge part 120. A runway control pin 140 on the second hinge part 120 side is inserted into the runway groove 114. The runway control pin 140 is fixed to the second hinge part 120 by a screw 141 which passes through a hole 123 formed in the second hinge part 120.

Four screw holes 115 are formed in the peripheral edge of the first hinge part 110.

The waterproof double-faced tape 132 having a shape as shown in FIG. 6 is placed on the back surface of the first hinge part 110. The waterproof double-faced tape 132 has a large hole 132*a* in a central portion thereof which is formed to avoid the annular groove 113 formed in the first hinge part 110 and a projection on the back surface side of the runway groove 114. The waterproof double-faced tape 132 has four holes 132*b* which are formed around the hole 132*a* and through which screws 131 are caused to pass. The waterproof double-faced tape 132 is attached on the back surface of the first hinge part 110. The waterproof double-faced tape 132 is interposed between the first hinge part 110 and the first case 300, and the first case 300 is fixed to the first hinge part 110 by the four screws 131. The screw holes 115 of the first hinge part 110 pass through the front and back surfaces of the first hinge part 110. Even if the screws 131 are screwed into the screw holes 115 in this state, there is a possibility that water enters from the screw holes 115 when a water pressure is applied thereto. Accordingly, in the embodiment, the front surface side of the screw holes 115, i.e., the second hinge part 120 side is covered with waterproof tapes 136.

Next, the second hinge part 120 will be explained.

The second hinge part 120 has the hole 121*a*, which is formed in a central portion thereof so as to pass through the front and back surfaces of the second hinge part 120, and the cylindrical projection 121 which projects to the first hinge part 110 side. The cylindrical projection 121 is inserted into the slot 111 formed in the first hinge part 110 and locked to the edge portion 112 formed in the periphery of the slot 111 so that the cylindrical projection 121 can be attached without being removed from the first hinge part 110. Specifically, a sliding spacer 138 is disposed in a back surface side of the edge portion 112. The cylindrical projection 121 passes through the slot 111 as well as passes through a spacer 134 having such a size that can enter the slot 111 and is caulked in that state by a caulking part 133 passing therethrough. With this arrangement, the cylindrical projection 121 is locked to the edge portion 112 in the state that passes through the slot 111 so that is prevented from being removed from the slot 111. However, the cylindrical projection 121 can move in a longitudinal direction of the slot 111 and rotate in the state that is inserted into the slot 111.

Here, a signal transmission cable is caused to pass through the hole 121*a* of the cylindrical projection 121. The cable passes through the opening 301 formed in the first case 300 and extends up to the inside of the support unit 30 including the first case 300 as shown in FIGS. 1 to 4. Further, the cable passes through the opening 4001 formed in the second case 400 and extends up to the inside of the display unit 40 including the second case 400 as shown in FIGS. 1 to 4.

The sliding surface 122 is formed around the periphery of the cylindrical projection 121 of the second hinge part 120 so that the gasket 137 inserted into the annular groove 113 formed in the first hinge part 110 slides thereon. The sliding surface 122 has such an expansion that receives the entire annular periphery of the gasket 137 in the entire relative moving loci of the first hinge part 110 and the second hinge part 120. Accordingly, regardless of what attitude the first hinge part 110 and the second hinge part 120 are placed in, water is prevented from entering the inside of the gasket 137. The sliding surface 122 is subjected to a surface treatment, such as (without limitation) TEFLON coating, to securely satisfy both a waterproofing property achieved by depressing the gasket 137 and a smooth motion when the first hinge part 110 and the second hinge part 120 relatively rotate and slide at the same time. Otherwise, a low friction part, such as (without limitation) a TEFLON tape, may be bonded on the sliding surface 122 or a similar performance may be given thereto by applying grease in place of the surface treatment.

The second hinge part 120 has the hole 123 through which the screw 141 passes. The runway control pin 140 is fixed to the second hinge part 120 by the screw 141 passing through the hole 123. The runway control pin 140 is fitted into the runway groove 114 formed in the first hinge part 110 and guided by the runway groove 114. The runway control pin 140 is fitted into the runway groove 114 and comes into contact with the bottom surface of the runway groove 114 so that also acts to regulate the gap between the first hinge part 110 and the second hinge part 120.

A runway, in which the attitudes of the first hinge part 110 and the second hinge part 120 are relatively changed, is determined by that the cylindrical projection 121 which is inserted into the slot 111 and guided thereby and that the runway control pin 140 which is inserted into the runway groove 114 and guided thereby.

Four screw holes 124 are formed in the peripheral edge of the first hinge part 120. A waterproof double-faced tape 142, in which a hole 142*a* is formed to avoid the hole 121*a* of the cylindrical projection 121, is disposed on the back surface of the second hinge part 120. Further, the second case 400 is disposed in the second hinge part 120 across the waterproof double-faced tape 142. The second case 400 is fixed to the second hinge part 120 by four screws 143 in a state that the waterproof double-faced tape 142 and annular screw-hole waterproof tapes 136 through which the respective screws 143 pass are clamped therebetween. The screw holes 124 formed in the second hinge part 120 pass through the front and back surfaces of the second hinge part 120. The openings on the front sides of the screw holes 124 are closed by screw-hole waterproof tapes 139 to prevent water from entering from the screw holes 124 as in the screw holes 115 of the first hinge part 110.

Figure 7:
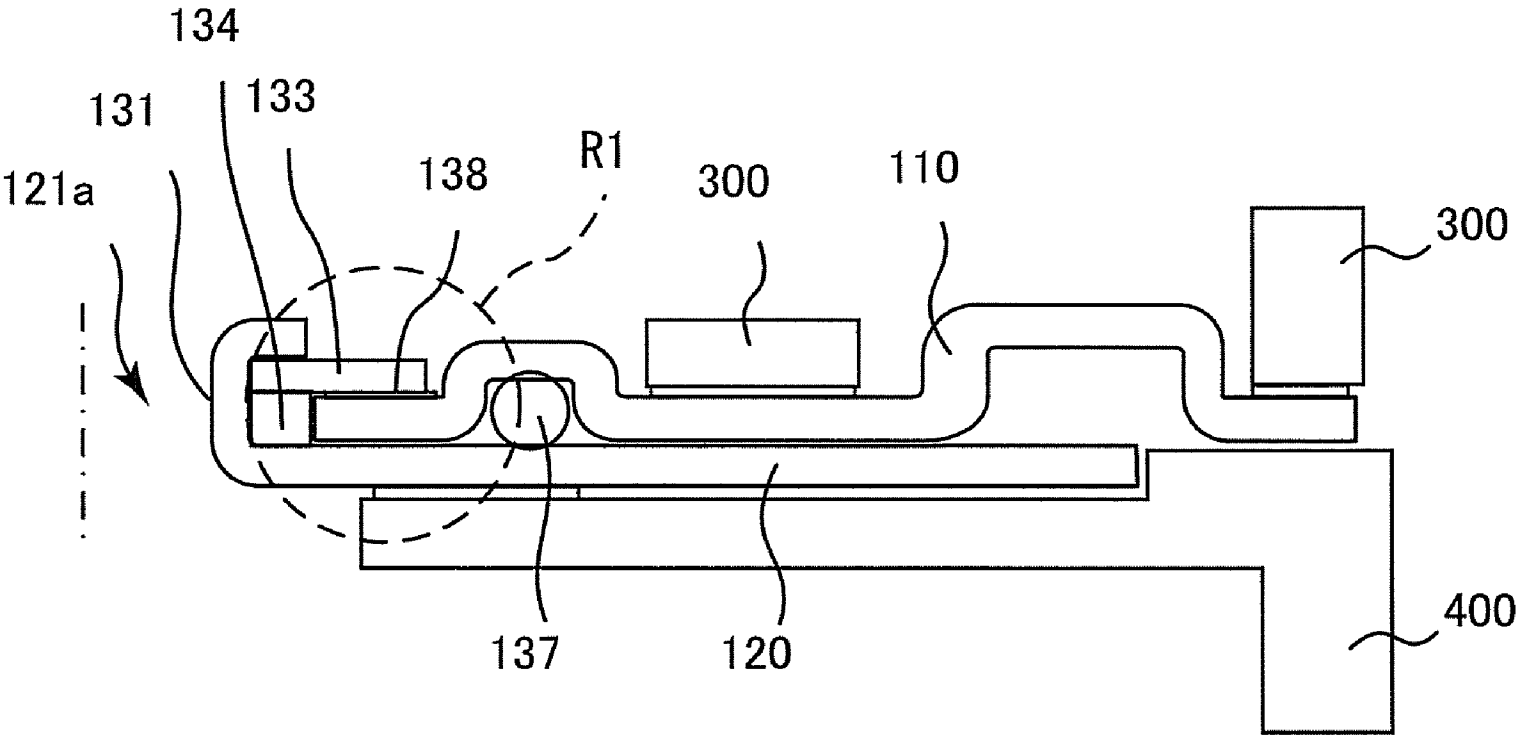
FIG. 7 is an enlarged view of a part of the section of the hinge module shown in FIG. 5B.
Figure 8:
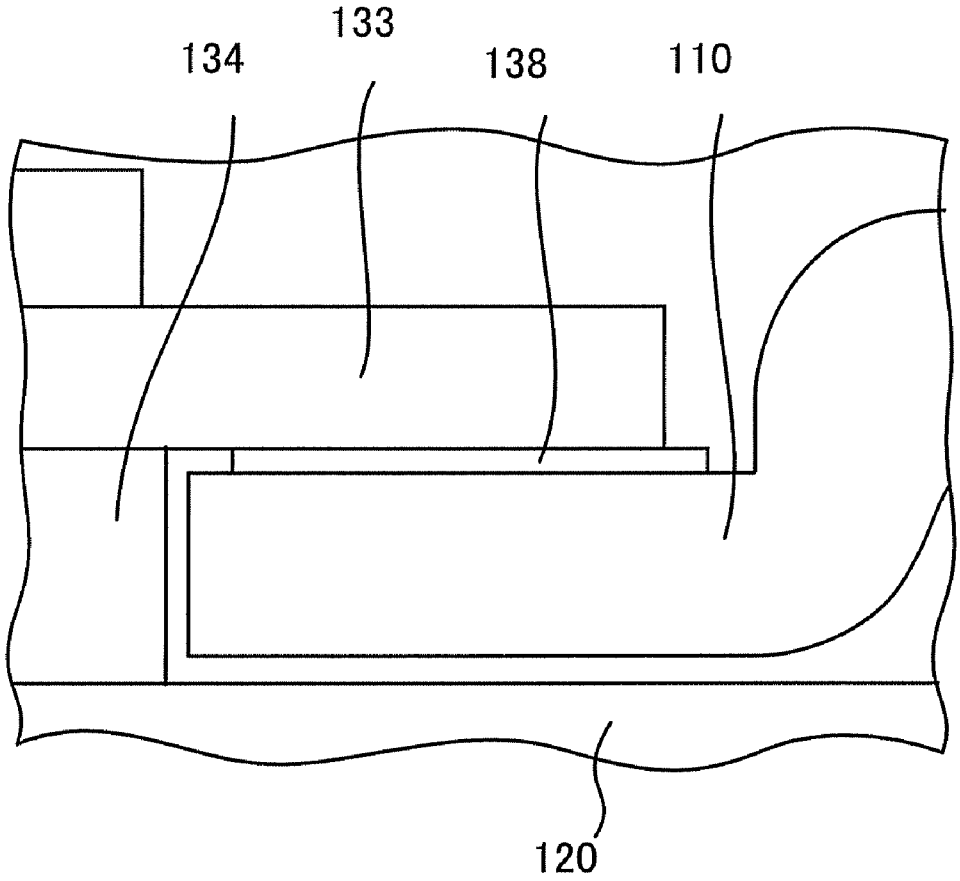
FIG. 8 is a view showing the portion in a circle R1 of FIG. 7 in further enlargement.

FIG. 7 is an enlarged view of a part of the section of the hinge module shown in FIG. 5B. FIG. 8 is a view showing the portion in a circle R1 of FIG. 7 in further enlargement.

The cylindrical projection 121 formed in the second hinge part 120 is caulked across the spacer 134 and the caulking part 133. Further, the sliding spacer 138 is interposed between the caulking part 133 and the first hinge part 110. The spacer 134 has a role for determining the gap between the first hinge part 110 and the second hinge part 120. When the spacer 134 is arranged as a part different from the caulking part 133 and the thickness thereof is appropriately selected at a manufacturing stage, the gap between the first hinge part 110 and the second hinge part 120 can be set to an appropriate size.

A material having a low friction resistance, for example, a polyacetal (POM) material and the like is used for the sliding spacer 138 so that the cylindrical projection 121 can smoothly rotate and slide in the slot 111.

Figure 9:
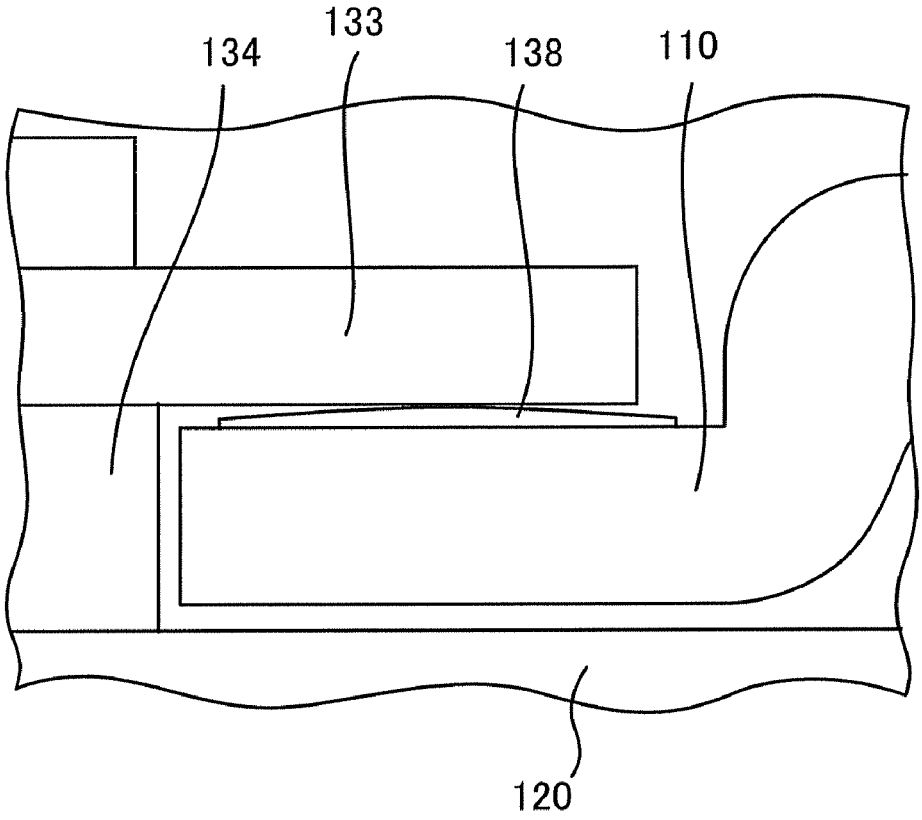
FIG. 9 is a view showing a modification of a sliding spacer.

FIG. 9 is a view showing a modification of the sliding spacer.

Although the sliding spacer 138 slides with respect to the caulking part 133, the sliding surface of the sliding spacer 138 on the caulking part 133 side is formed in an arc shape in a modification shown in FIG. 9. When the sliding surface of the sliding spacer 138 is formed in the arc shape, since the friction resistance thereof is more reduced, the sliding spacer 138 can move more smoothly.

The sliding spacer may be formed in a shape matched to the outer shape of the caulking part 133 and fixed to the caulking part 133. In this case, the sliding spacer 138 slides with respect to the first hinge part 110, and is preferable in this case to form the surface of the sliding spacer 138 on the first hinge part 110 side in an arc shape.

Figure 10:
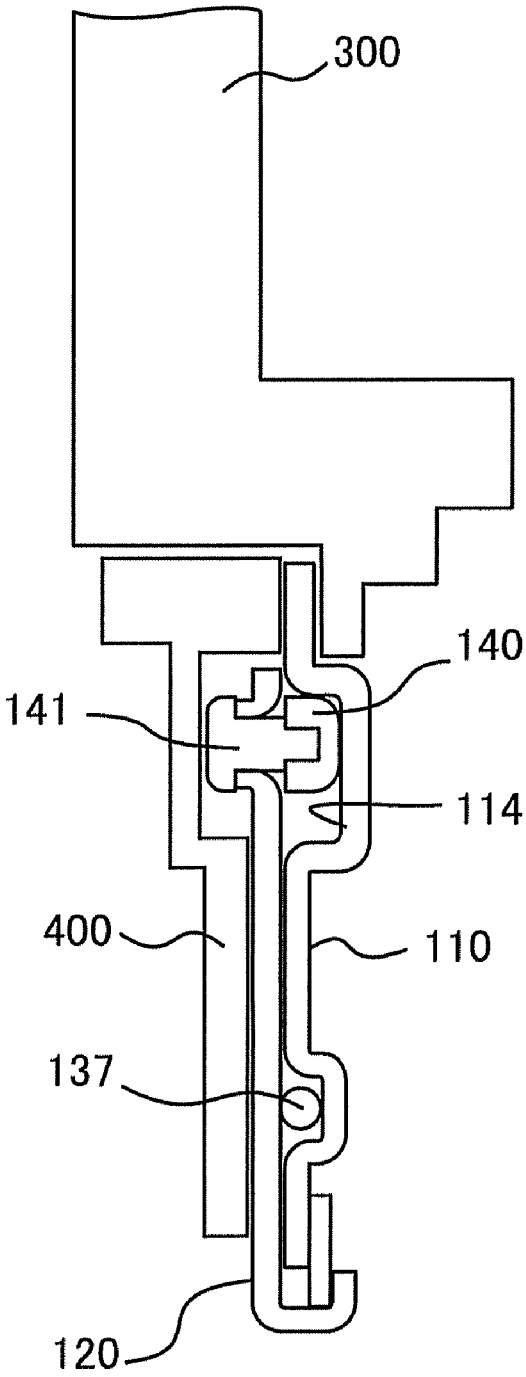
FIG. 10 is an enlarged view of a part of the section of the hinge module shown in FIG. 5C.
Figure 11:
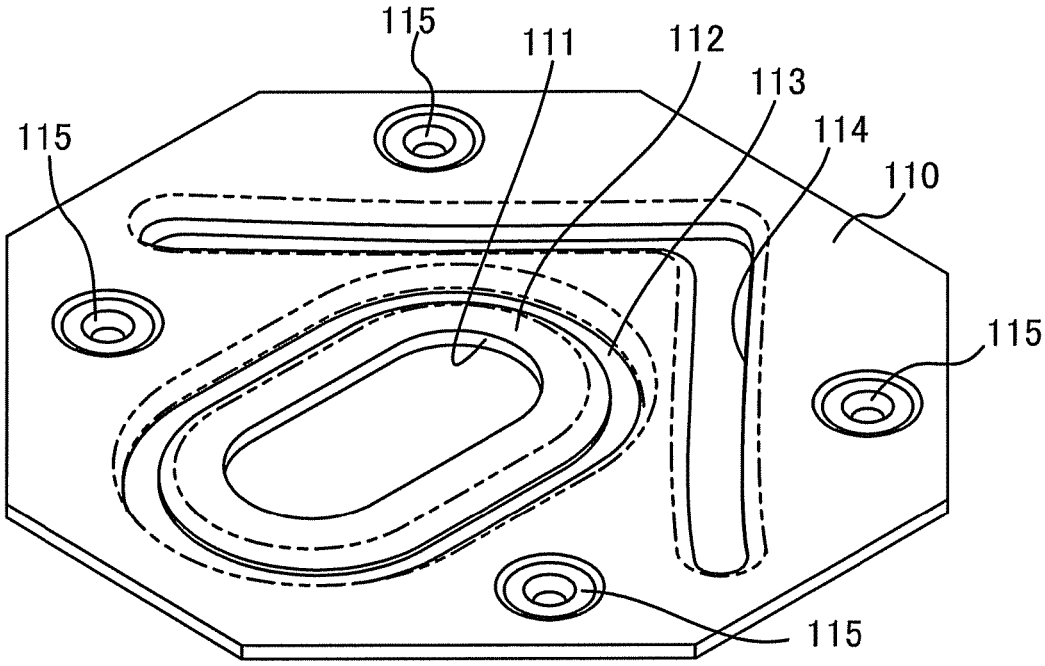
FIG. 11 is a perspective view showing the surface of a first hinge part on a second hinge part side.

FIG. 10 is an enlarged view of a part of the section of the hinge module shown in FIG. 5C. FIG. 11 is a perspective view showing the surface of the first hinge part on the second hinge part side. FIG. 11 is a view explaining the runway groove 114, which has a recessed shape having a predetermined depth.

FIG. 10 shows a state that the runway control pin 140 is inserted into the runway groove 114 and comes into contact with the bottom surface of the runway groove. The screw 141 and the runway control pin 140 are formed to such lengths that when the runway control pin 140 is attached by the screw 141 as described above, the runway control pin 140 comes into contact with the bottom surface of the runway groove 114. As a result, the runway control pin 140 can be provided with such a role that is guided by the runway groove 114 and determines a rotating motion and a sliding motion. Further, the runway control pin 140 may be provided with a role for determining the gap between the first hinge part 110 and the second hinge part 120.

Figure 12:
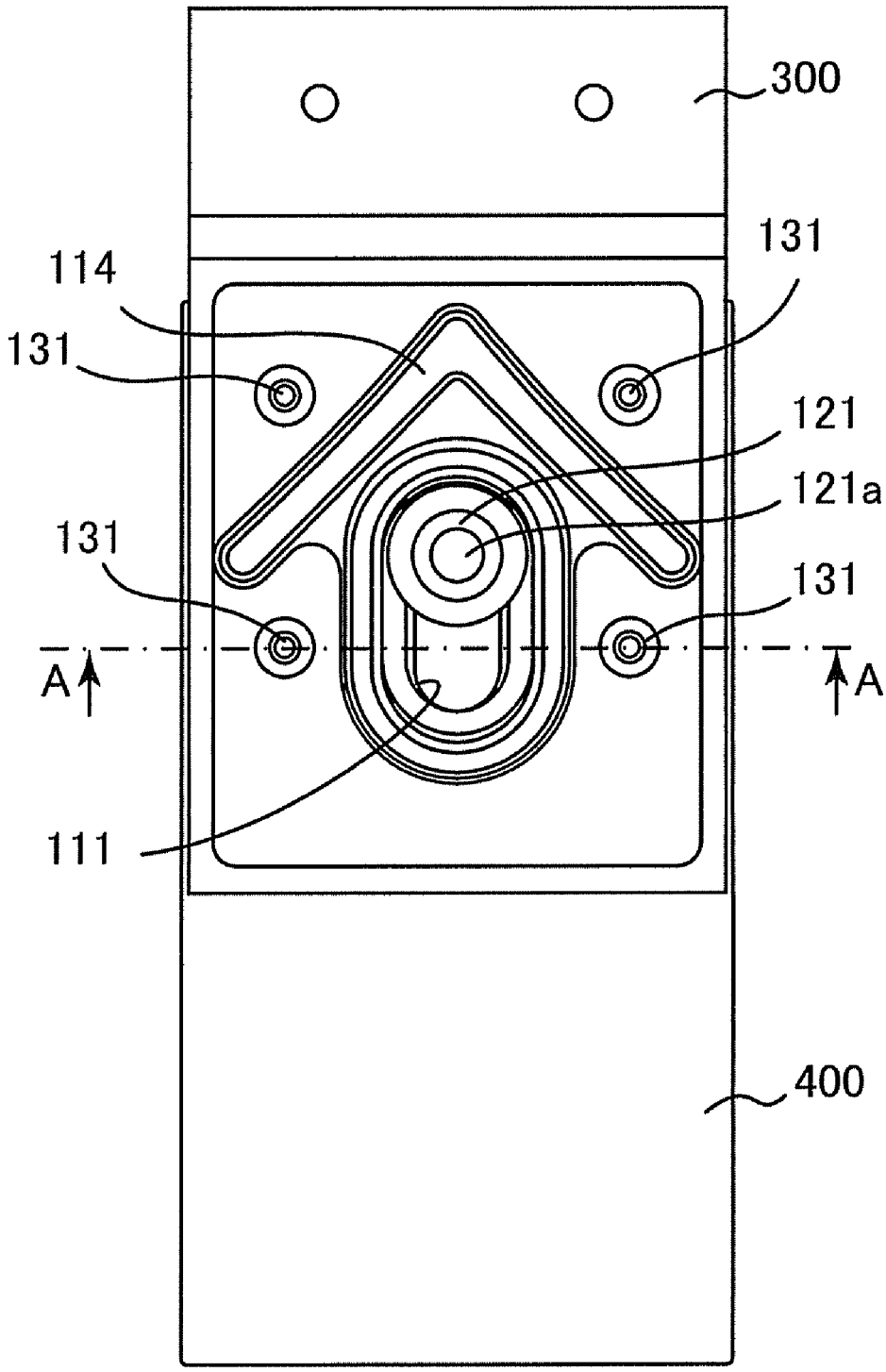
FIG. 12 is an enlarged plan view of the hinge module shown in FIG. 5A.
Figure 13:
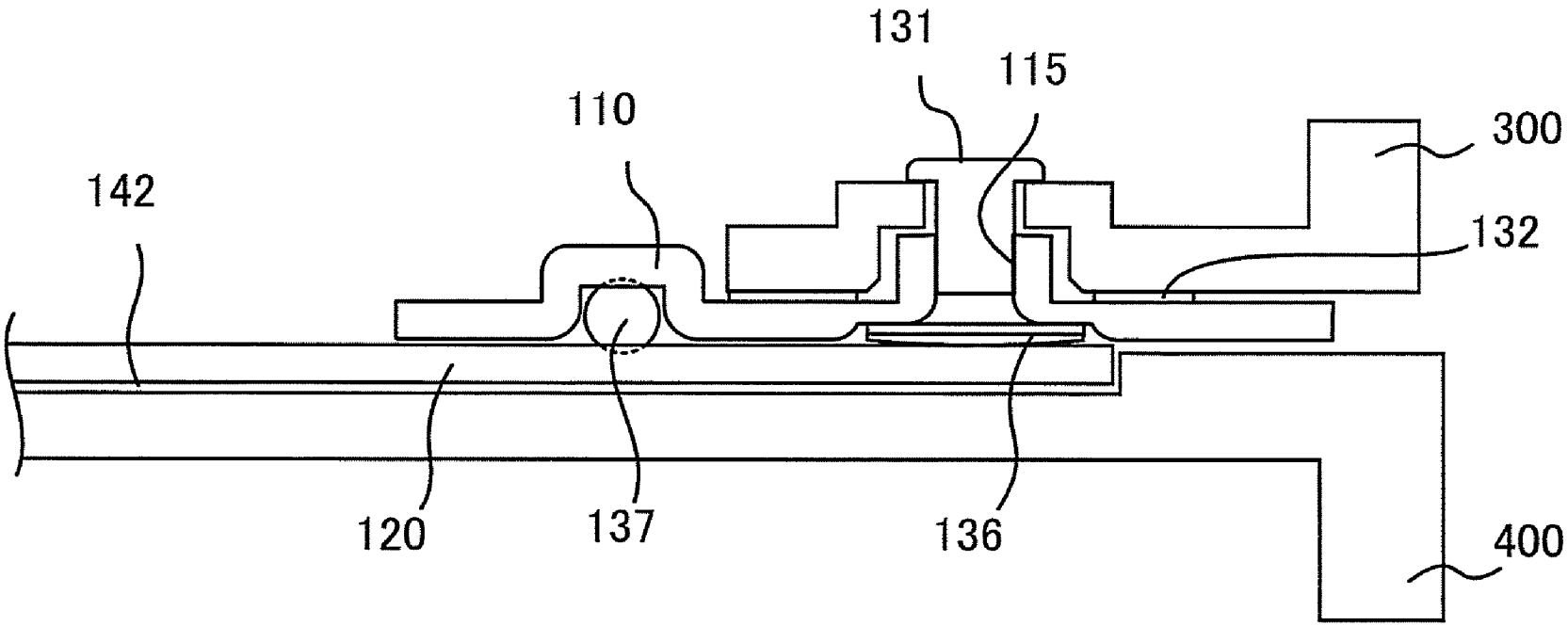
FIG. 13 is an enlarged view of a part of the section taken along an arrow A-A of FIG. 12.

FIG. 12 is a plan view of the hinge module of FIG. 5A and shown again to show a cross section of FIG. 13. FIG. 13 is an enlarged view of a part of the cross section taken along an arrow A-A shown in FIG. 12.

As shown in FIG. 13, the screw holes 115, which are formed in the first hinge part 110 to fix the first case 300 and the first hinge part 110 by the screws 131, extend to openings on the second hinge part 120 side, and the screw-hole waterproof tapes 136 are bonded to the openings. With this arrangement, water and dusts are prevented from entering from the screw holes 115.

Note that although the screw holes 115 of the first hinge part 110 and the screw-hole waterproof tapes 136 for closing the screw holes 115 have been explained, the screw holes 124 of the second hinge part 120 and the screw-hole waterproof tapes 139 for closing the screw holes 124 shown in FIG. 6 also have the same role.

Figure 14B:
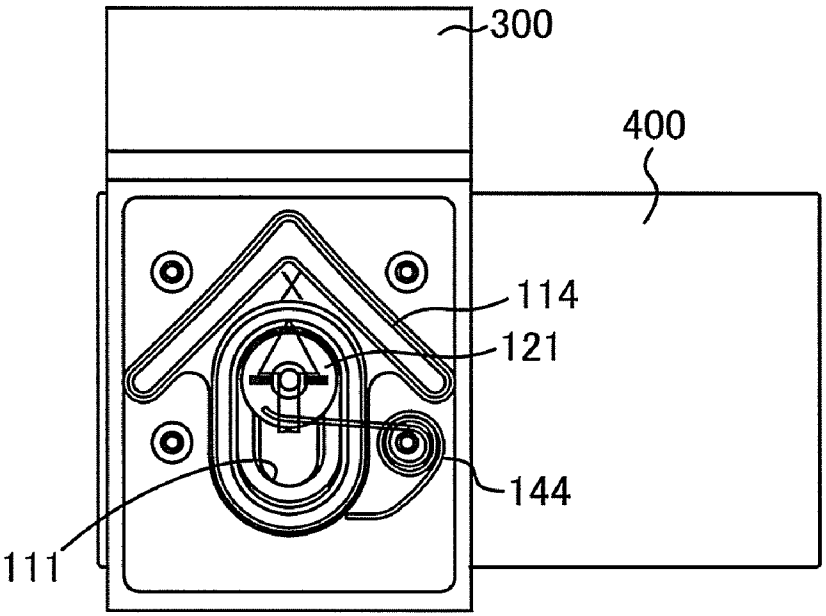
FIG. 14B is a view showing the second case in a state that is fallen laterally with respect to the first case.
Figure 14A:
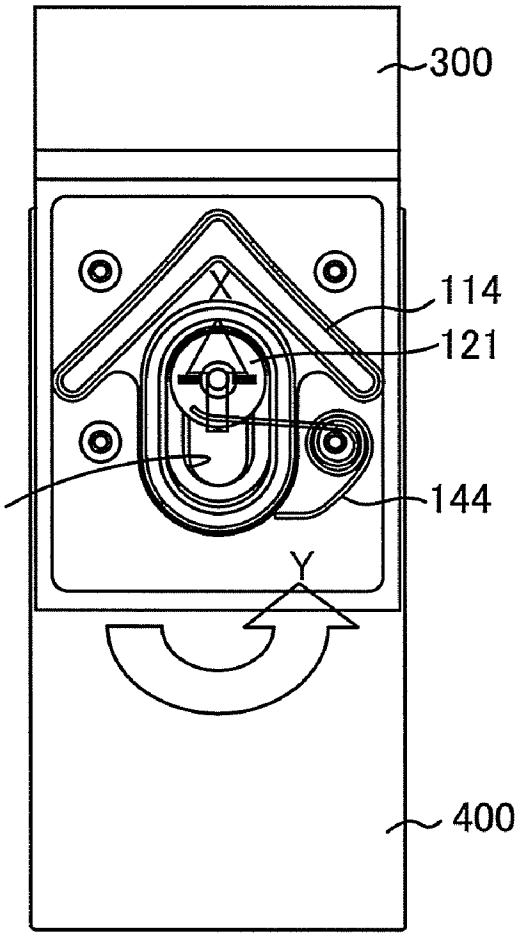
FIG. 14A is a view showing a second case in a standing state with respect to the first case.

FIG. 14A is a view showing the second case in a standing state with respect to the first case. FIG. 14B is a view showing the second case in a state that is fallen laterally with respect to (or in relation to) the first case 300.

Figure 2:
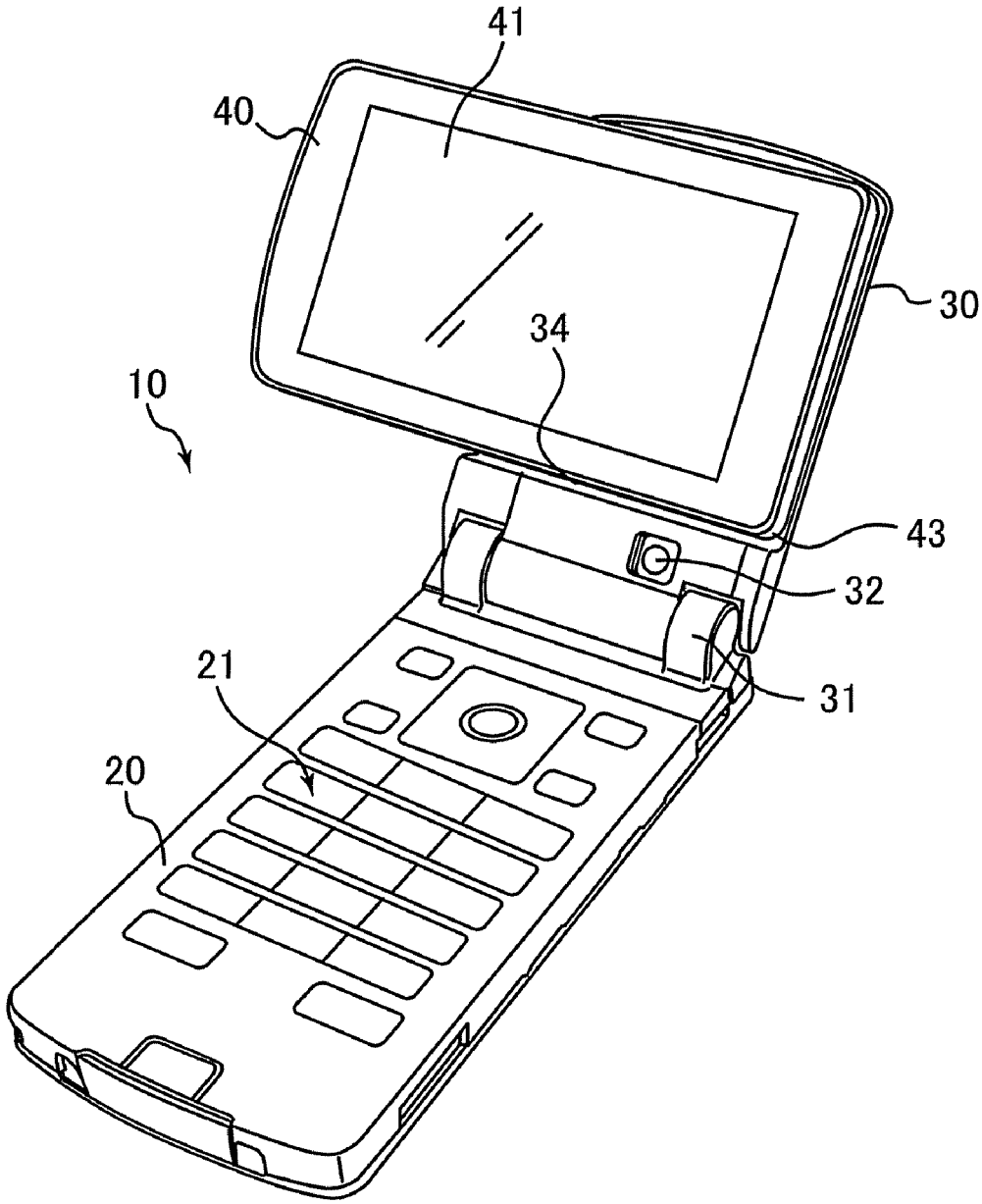
FIG. 2 is a perspective view showing the display unit in a leftward-fallen state.
Figure 3:
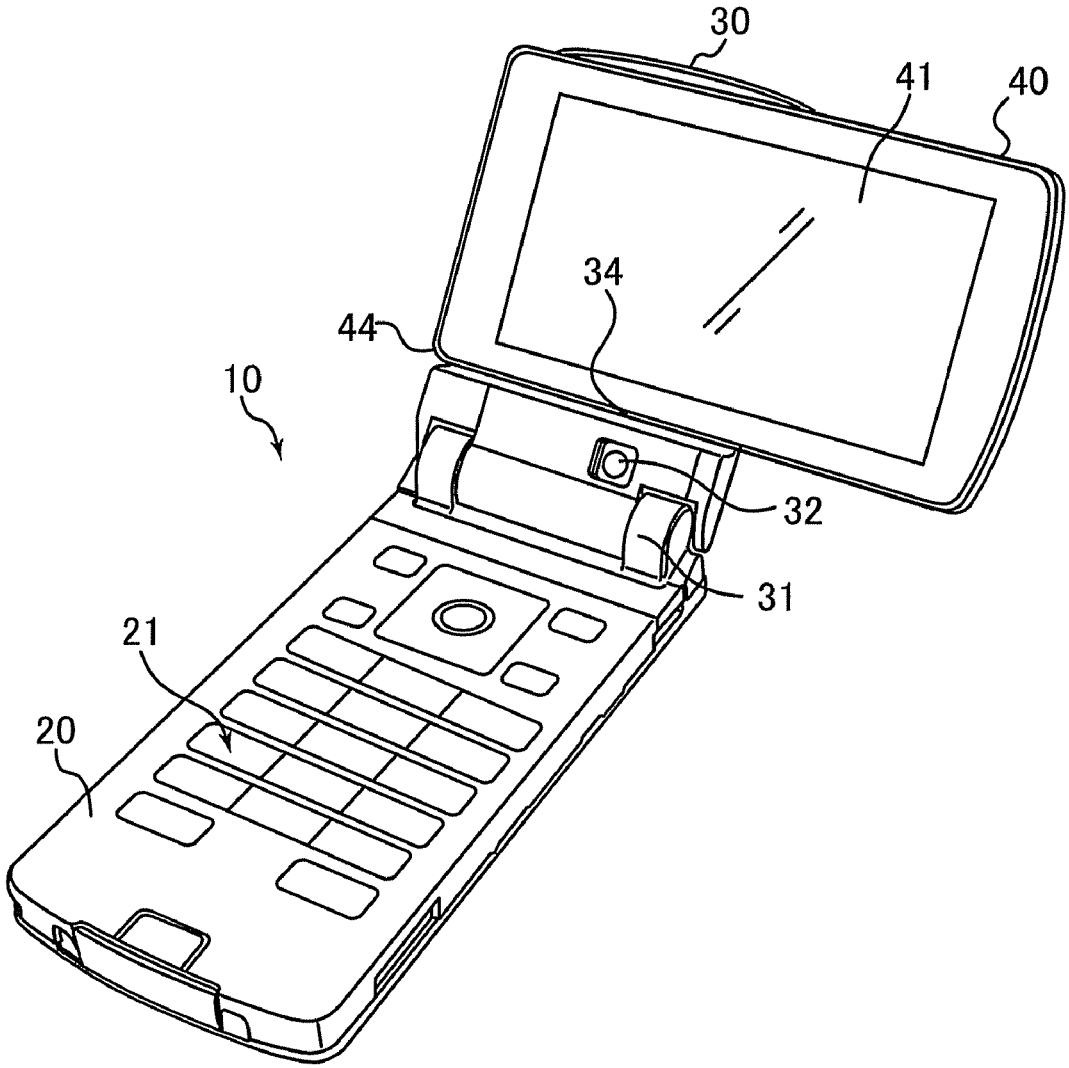
FIG. 3 is a perspective view showing the display unit in a rightward-fallen state.
Figure 4:
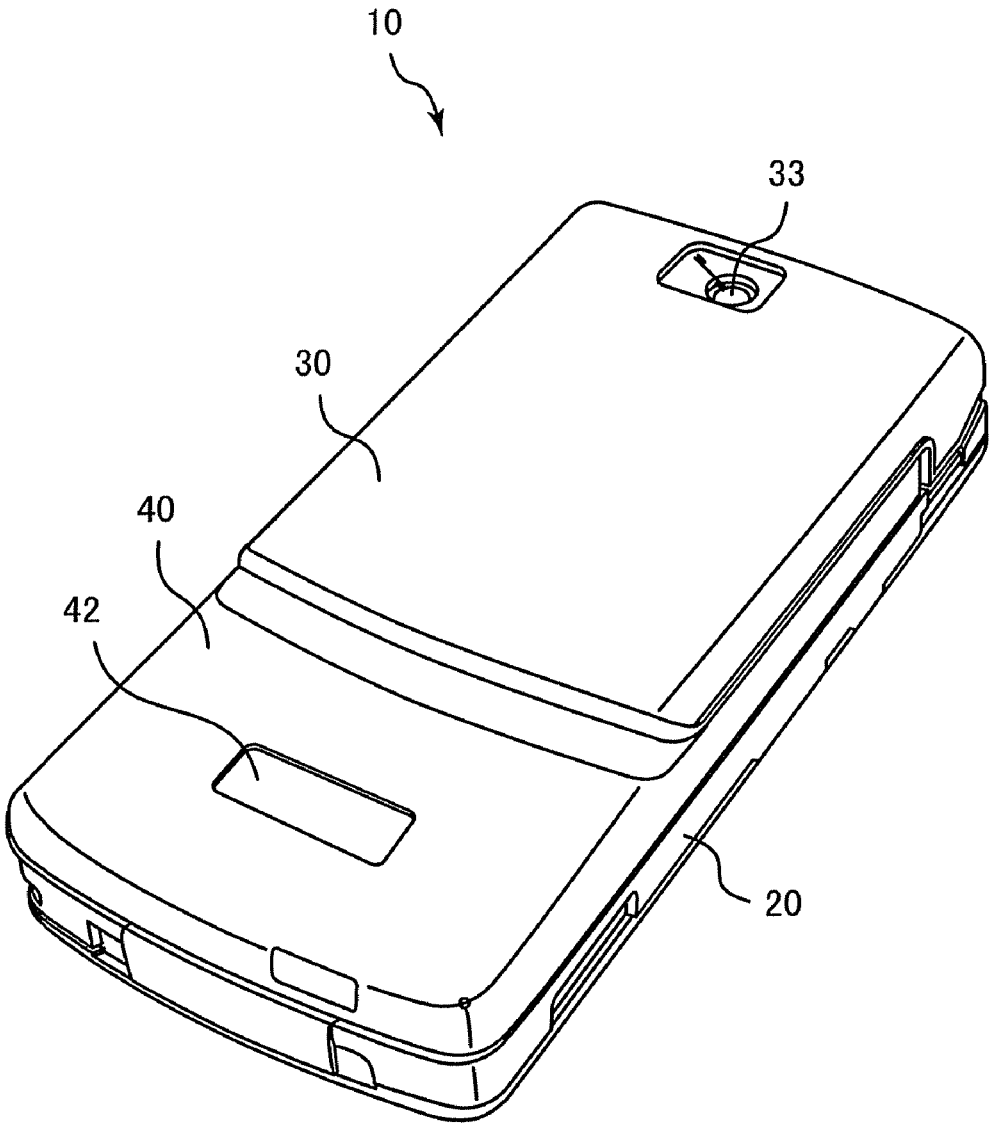
FIG. 4 is a perspective view showing a state that the display unit is closed on a main body unit.

FIGS. 14A and 14B show a spring 144. The spring 144 urges the cylindrical projection 121 in a direction (direction shown by arrow X in FIG. 14A) near the runway groove 114 in the slot 111 at all times. Accordingly, when the second case 400 is intended to rotate in a direction shown by an arrow Y, the second case 400 moves to a standing position shown in FIG. 14A or to a laterally-fallen position shown in FIG. 14B, even if a hand is removed from the second case 400 while the second case 400 is being rotated. Therefore, the second case 400 is stabilized at the standing position shown in FIG. 14A, the laterally-fallen position shown in FIG. 14B, and a not-shown laterally fallen position at which is fallen in a direction opposite to the direction shown in FIG. 14B. FIGS. 1 to 3 show these states.

Note that although FIGS. 14A and 14B exemplify a coil spring, a sheet spring or the like may be used in place of the coil spring. Further, the attachment position of the spring shown in FIGS. 14A and 14B is only an example and is changed according to the shape and the like thereof.

Next, a modification of the embodiment will be explained.

Figure 15B:
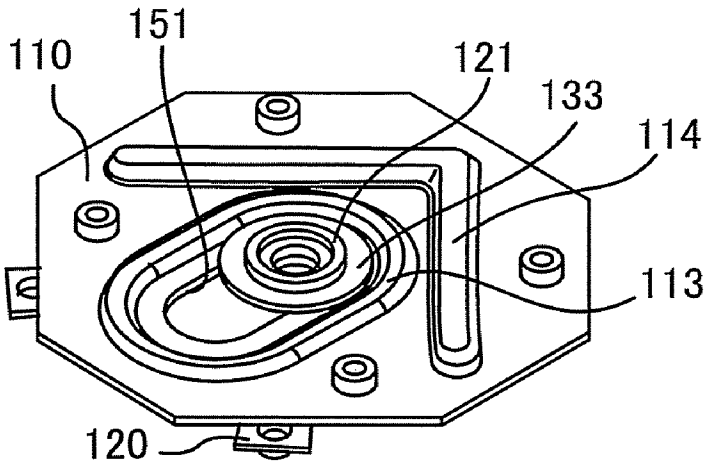
FIG. 15B is a perspective view showing that the first hinge and the second hinge are in a combined state when viewed from the first hinge part side.

FIG. 15 is a perspective view showing that the first hinge and the second hinge are in a combine state. FIG. 16 is a perspective view showing the surface of the first hinge part facing the second hinge part side.

Figure 15A:
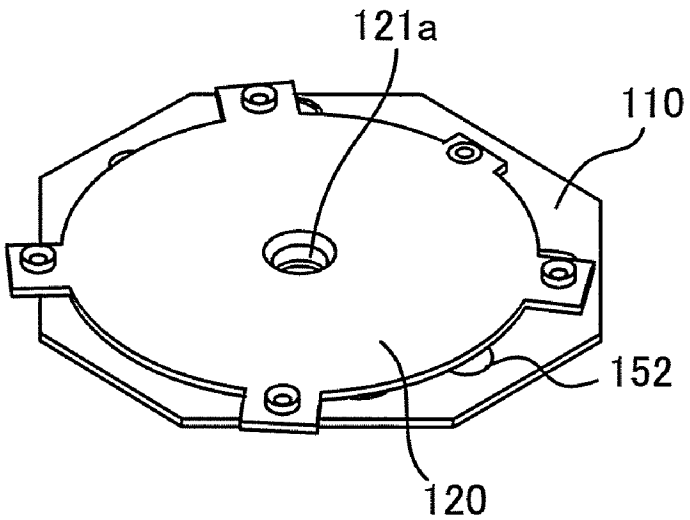
FIG. 15A is a perspective view showing that the first hinge and the second hinge are in a combined state when viewed from the second hinge part side.
Figure 16:
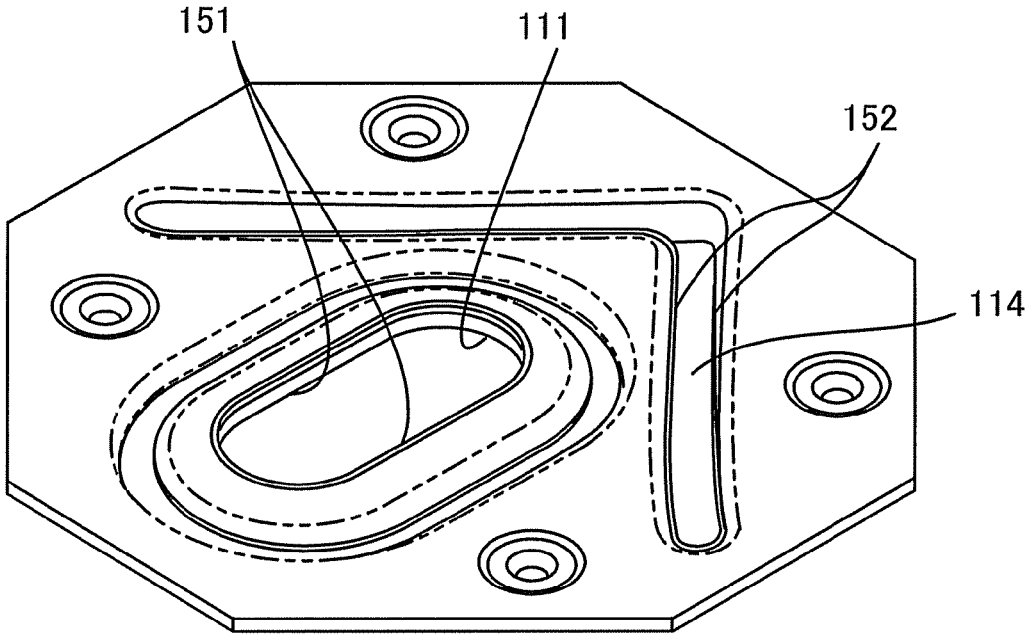
FIG. 16 is a perspective view showing the surface of the first hinge part facing the second hinge part side.

FIG. 15A is a perspective view showing that the first hinge and the second hinge are in a combined state when viewed from the second hinge part side. FIG. 15B is a perspective view showing that the first hinge and the second hinge are in a combined state when viewed from the first hinge part side.

Figure 17C:
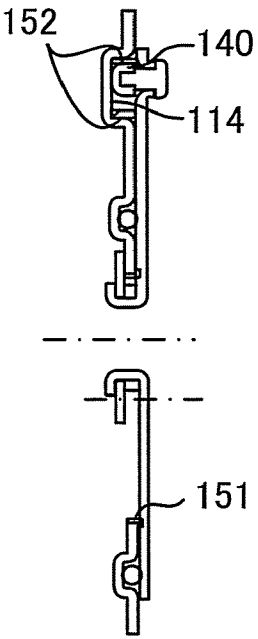
FIG. 17C is a sectional view taken along an arrow B-B of FIG. 17A.
Figure 17A:
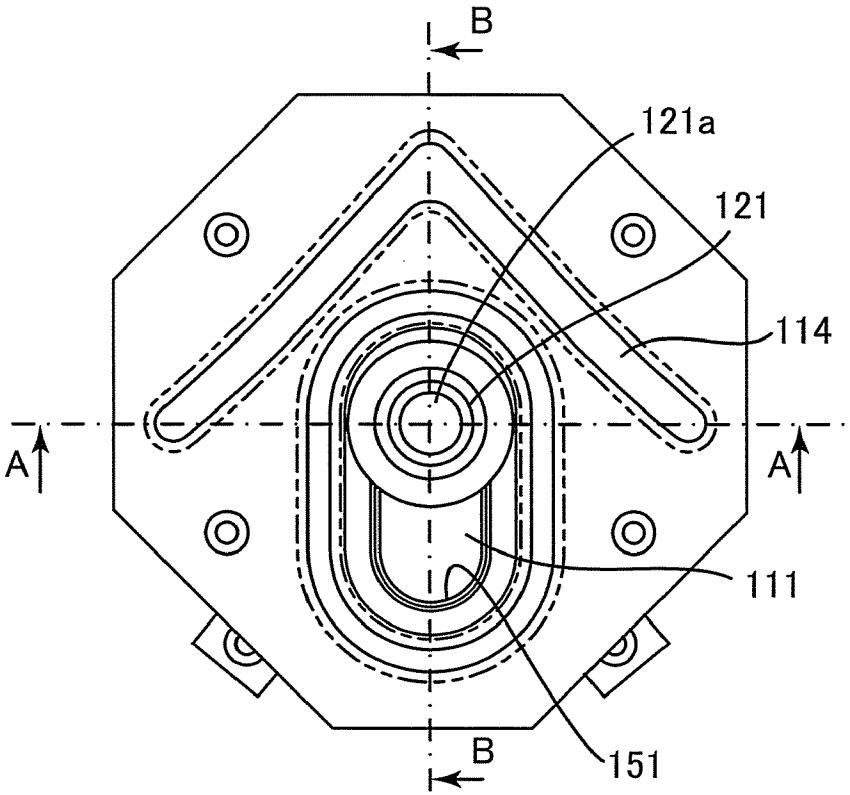
FIG. 17A is a front elevational view showing that the first hinge part and the second hinge part are in a combined state.
Figure 17B:
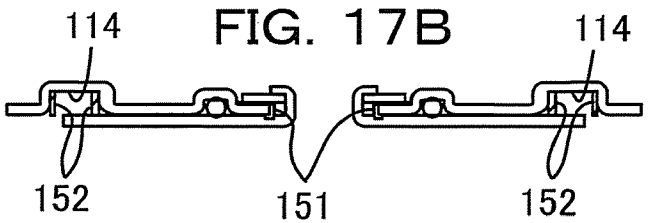
FIG. 17B is a sectional view taken along an arrow A-A of FIG. 17A.

FIG. 17 is a perspective view showing that the first hinge part and the second hinge part are in a combine state. FIG. 17A is a front elevational view showing that the first hinge part and the second hinge part are in a combined state. FIG. 17B is a sectional view taken along an arrow A-A of FIG. 17A. FIG. 17C is a sectional view taken along an arrow B-B of FIG. 17A.

Figure 18:
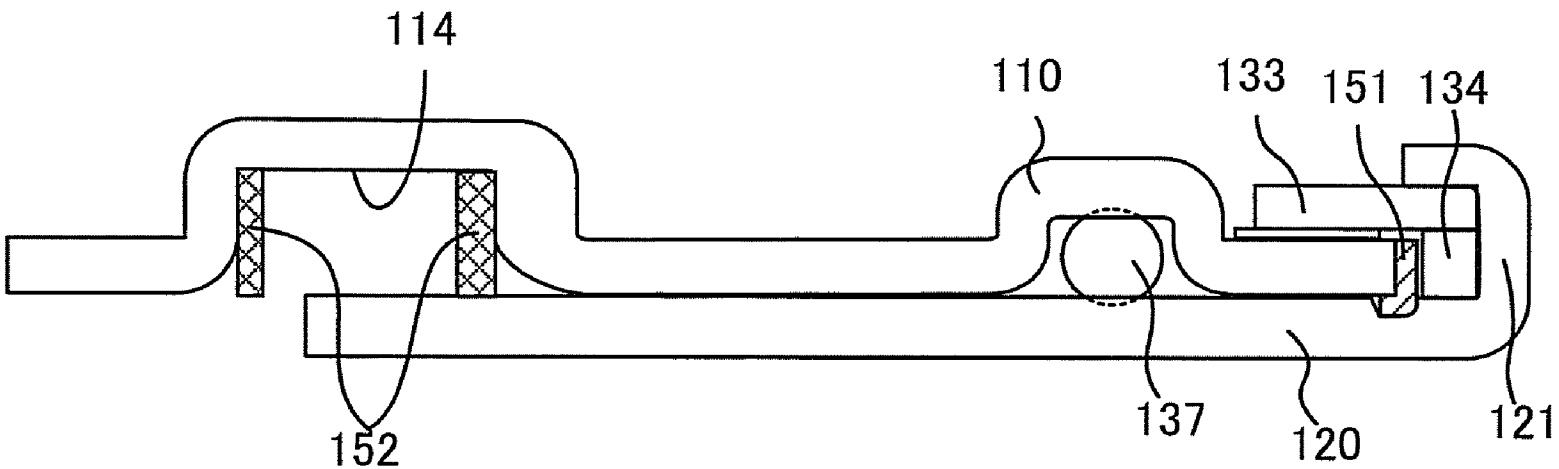
FIG. 18 is an enlarged view of a part of the sectional view shown in FIG. 17B.

FIG. 18 is an enlarged view of a part of the sectional view shown in FIG. 17B.

As shown in FIGS. 15A, 15B, 16, 17A, 17B, 17C, and 18, a sliding member 151 composed of a resin having an excellent lubricating property is disposed on an end face of the slot 111. Further, a sliding member 152 composed of a resin having an excellent lubricating property is also disposed on a side wall of the runway groove 114. A polyacetal (POM) resin and a TEFLON resin, for example, can be used as the sliding members 151, 152 having the excellent lubricating property.

When the sliding member 151 is disposed on the end face of the slot 111, friction between the slot 111 of the first hinge part 110 and the cylindrical projection 121 of the second hinge part 120 is reduced. When the sliding member 152 is disposed on the side wall of the runway groove 114, friction between the runway groove 114 of the first hinge part 110 and the runway control pin 140 on the second hinge part 120 side is reduced. In either case, a relative rotating motion and a relative sliding motion can be more smoothly carried out between the first hinge part 110 and the second hinge part 120.

In the embodiment described above, the waterproof double-faced tape 132 shown in FIG. 6 has a role of a waterproof function between the first case 300 and the first hinge part 110, and the other waterproof double-faced tape 142 has a role of a waterproof function between the second case 400 and the second hinge part 120. The first case 300 is fixed to the first hinge part 110 across a waterproof seal or an adhesive layer which has such a shape that surrounds the periphery of the opening 301 of the first case once in place of the double-faced tape 132. The second case 400 is fixed to the second hinge part 120 across a waterproof seal or an adhesive layer which has such a shape that surrounds the periphery of the opening 4001 of the second case once in place of the double-faced tape 142. A waterproofing property may be secured by the above arrangement between the first case 300 and the first hinge part 110 and between the second case 400 and the second hinge part 120. Otherwise, as another modification, water may be prevented from entering the opening 301 of the first case by heat welding the first case 300 to the first hinge part 110 in such a shape that surrounds the opening 301 thereof once. Water may be prevented from entering the opening 4001 of the second case by heat welding the second case 400 to the second hinge part 120 in such a shape that surrounds the opening 4001 thereof once.

As described above, the waterproofing property can be secured between the first case 300 and the first hinge part 110 and between the second case 400 and the second hinge part 120 by various means.

Note that, in the embodiment, although the mobile phone has been explained as an example of waterproof electronic equipment, the embodiment is not limited to the mobile phone and can be widely applied to electronic equipment which requires both rotating and sliding motions.

The embodiment has the following operation/working-effects.

The embodiment prevents water from entering the slot 111 and the hole 121*a* of the cylindrical projection 121.

Since the embodiment has the runway groove 114 and the runway control pin 140, the change of attitude caused by the rotating motion and the sliding motion can be regulated on one runway.

In the embodiment, since the sliding spacer 138 is provided, the rotating motion and the sliding motion can be stably realized by maintaining compression of the gasket 137 to a predetermined amount.

In the embodiment, since the material having the low sliding resistance composed of, for example, the resin is used for the sliding spacer 138 and the sliding spacer 138 is formed in the arc shape, the sliding resistance thereof is further reduced and thus a smooth rotating motion and a smooth sliding motion can be realized.

In the embodiment, since the sliding surface has such an expansion that receives the entire periphery of the gasket 137 in the entire region of the moving locus, a waterproof performance can be securely maintained regardless of the movement of the first hinge part 110 and second hinge part 120.

In the embodiment, since the predetermined gap is maintained between the first hinge part 110 and the second hinge part 120, a smooth motion can be secured.

In the embodiment, since friction force between parts is reduced, a smoother rotating motion and a smoother sliding motion can be realized.

In the embodiment, since the amount of compression of the gasket 137 can be properly adjusted by adjusting the thickness of the spacer 134 at a manufacturing stage, maintenance of the waterproofing property and the smooth rotating and sliding motions can be satisfied at the same time very securely.

In the embodiment, provision of the urging member permits the attitudes of the first hinge part 110 and the second hinge part 120 to be more stably maintained.

In the embodiment, the first case 300 and the second case 400 can be relatively rotated and slid. Further, the inside of the first case 300 can be connected to the inside of second case 400 by the cable, and a signal can be transmitted and received through the cable.

In the embodiment, the waterproofing property is also maintained between the first case 300 and the first hinge part 110 and between the second case 400 and the second hinge part 120.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed is:

1. A hinge module for a mobile equipment, the hinge module comprising:

a first hinge part; and a second hinge part confronting the first hinge part, wherein the first hinge part includes:

a slot passing through a front surface and a back surface, extended in a longitudinal direction, an annular groove, having an edge portion formed thereon, surrounding the slot and formed in a recessed shape with respect to the second hinge part, and an annular gasket inserted into the annular groove with a part of the gasket projecting to the second hinge part side; and the second hinge part includes:

a cylindrical projection preventing the second hinge part from being removed from the slot of the first hinge part to allow free movement of the second hinge part in the longitudinal direction of the slot and in a direction of rotation relative to the first hinge part; and a sliding surface which is formed around periphery of the cylindrical projection and on which the gasket slides in the longitudinal direction of the slot and in a direction of rotation relative to the cylindrical projection when the second hinge part moves along the slot of the first hinge part.

2. The hinge module according to claim 1, wherein one of the first hinge part and the second hinge part includes a runway groove formed in a recessed shape with respect to the other hinge part, the other hinge part includes a runway control pin inserted into the runway groove, and the cylindrical projection guided by the slot and the runway control pin guided by the runway groove determine the runway of the first hinge part and the second hinge part and change positions of the first hinge part and the second hinge part relative to each other.

3. The hinge module according to claim 1, wherein the cylindrical projection locks to the edge portion through a sliding spacer interposed therebetween.

4. The hinge module according to claim 3, wherein a surface of the sliding spacer on a side which slides between adjacent parts when the cylindrical projection moves in the slot, is formed in an arc shape.

5. The hinge module according to claim 1, wherein the sliding surface has an expansion for receiving the entire annular periphery of the gasket in entire relative moving loci of the first hinge part and the second hinge part.

6. The hinge module according to claim 2, wherein the runway control pin is of a length to come into contact with a bottom surface of the runway groove and regulates a gap between the first hinge part and the second hinge part.

7. The hinge module according to claim 1, wherein the first hinge part includes a sliding member disposed on an end face of the slot.

8. The hinge module according to claim 2, wherein one of the hinge parts includes a sliding member disposed on a side wall of the runway groove.

9. The hinge module according to claim 1, wherein the sliding surface includes a surface treatment reducing sliding friction to the gasket.

10. The hinge module according to claim 1, wherein the cylindrical projection locks to the edge portion across a spacer which determines the gap between the first hinge part and the second hinge part.

11. The hinge module according to claim 1, further comprising an urging member urging the cylindrical projection to one of the ends of the slot.

12. An electronic equipment comprising:

a hinge module including a first hinge part and a second hinge part confronting the first hinge part, wherein the first hinge part comprises:

a slot passing through a front surface and a back surface, extended in a longitudinal direction, an annular groove, having an edge portion formed thereon, surrounding the slot and formed in a recessed shape with respect to the second hinge part, and an annular gasket inserted into the annular groove with a part of the gasket projecting to the second hinge part side, and wherein the second hinge part comprises:

a cylindrical projection preventing the second hinge part from being removed from the slot of the first hinge part to allow free movement of the second hinge part in the longitudinal direction of the slot and in a direction of rotation relative to the first hinge part, and a sliding surface which is formed around periphery of the cylindrical projection and on which the gasket slides in the longitudinal direction of the slot and in a direction of rotation relative to the cylindrical projection when the second hinge part moves along the slot of the first hinge part;

a first case having a first opening communicating with the slot and fixed to the first hinge part; and a second case having a second opening communicating with a hole of the cylindrical projection and fixed to the second hinge part.

13. The electronic equipment according to claim 12, wherein the first case is fixed to the first hinge part across a first waterproof double-faced tape surrounding periphery of the first opening, and the second case is fixed to the second hinge part across a second waterproof double-faced tape surround periphery of the second opening.

14. The electronic equipment according to claim 12, wherein the first case is fixed to the first hinge part across a first waterproof seal or an adhesive surrounding periphery of the first opening, and the second case fixed to the second hinge part across a second waterproof seal or an adhesive surrounding periphery of the second opening.

15. The electronic equipment according to claim 12, wherein the first case is heat welded to the first hinge part in such a shape that surrounds the periphery of the first opening to prevent water from entering the first opening, and the second case is heat welded to the second hinge part in such a shape that surrounds the periphery of the second opening to prevent water from entering the second opening.

16. A hinge module, comprising:

a first hinge part; and a second hinge part confronting the first hinge part, wherein the first hinge part includes:

a slot extended in a longitudinal direction; and an annular groove surrounding the slot and formed in a recessed shape in relation to the second hinge part, an annular gasket inserted into the annular groove and projecting to the second hinge part side, and the second hinge part includes:

a cylindrical projection non-removably inserted into the slot while freely moveable in the longitudinal direction of the slot and in a direction of rotation relative to the first hinge part; and a sliding surface formed around periphery of the cylindrical projection and on which the gasket slides in the longitudinal direction of the slot and in a direction of rotation relative to the cylindrical projection when the second hinge part moves along the slot of the first hinge part.

* * * * *